US008393045B2

(12) United States Patent
O'Reilly

(10) Patent No.: US 8,393,045 B2
(45) Date of Patent: Mar. 12, 2013

(54) EFFICIENT, HAND-HELD MATTER REMOVAL SYSTEMS

(75) Inventor: Wanda L. O'Reilly, Breckenridge, CO (US)

(73) Assignee: It's About Time 2, Inc., Breckenridge, CO (US)

( * ) Notice: Subject to any disclaimer, the term of this patent is extended or adjusted under 35 U.S.C. 154(b) by 2470 days.

(21) Appl. No.: 11/097,750

(22) Filed: Apr. 1, 2005

(65) Prior Publication Data

US 2006/0207048 A1 Sep. 21, 2006

Related U.S. Application Data

(60) Provisional application No. 60/663,005, filed on Mar. 18, 2005.

(51) Int. Cl.
*A47L 13/02* (2006.01)

(52) U.S. Cl. ..... 15/236.01; 15/236.07

(58) Field of Classification Search ..... 15/235.4, 15/235.7, 236.01, 236.02, 236.04, 236.07; 30/169; D32/46, 48, 49; D8/45
See application file for complete search history.

(56) References Cited

U.S. PATENT DOCUMENTS

| | | | | | |
|---|---|---|---|---|---|
| 2,807,168 | A | | 9/1957 | Wipf et al. | |
| 2,944,275 | A | * | 7/1960 | Markusen | 15/236.01 |
| 3,178,747 | A | * | 4/1965 | Peterson | 15/236.01 |
| 3,676,888 | A | * | 7/1972 | Akers | 15/245 |
| 4,097,951 | A | * | 7/1978 | Hurtt | 15/245.1 |
| 4,381,576 | A | | 5/1983 | Nishikawa | |
| 4,627,128 | A | | 12/1986 | Shea | |
| 4,674,186 | A | | 6/1987 | Galiano | |
| 4,987,635 | A | | 1/1991 | Young | |
| 5,065,977 | A | * | 11/1991 | Desjardin | 248/692 |
| 5,201,121 | A | * | 4/1993 | Heiberg | 30/123 |
| 5,272,786 | A | * | 12/1993 | Edstrom | 15/236.07 |
| 5,345,642 | A | * | 9/1994 | Faldetta | 15/105 |
| 5,491,868 | A | * | 2/1996 | Baggenstos | 15/236.09 |
| 368,344 | A | | 3/1996 | Hansen | |
| 5,626,683 | A | * | 5/1997 | Blouin | 134/8 |
| D383,267 | S | * | 9/1997 | Emmerth | D32/46 |
| 388,569 | A | | 12/1997 | Israel | |
| 5,706,546 | A | * | 1/1998 | Utley | 15/236.01 |
| 5,732,434 | A | | 3/1998 | McCarty | |
| D394,371 | S | * | 5/1998 | Cousins | D7/691 |
| 5,799,997 | A | | 9/1998 | Lehn et al. | |
| 405,661 | A | | 2/1999 | Erickson | |
| 6,393,650 | B1 | | 5/2002 | Gerakos | |
| 2002/0002754 | A1 | * | 1/2002 | Wendel | 15/245.1 |
| 2004/0068819 | A1 | | 4/2004 | Nistico | |
| 2005/0193516 | A1 | * | 9/2005 | Hughes | 15/236.01 |

OTHER PUBLICATIONS

Freund Container, 2005 Catalog, p. 37, Colored or Silk Screened Open Head Pails.
Freund Container, 2005 Catalog, p. 41, 5 Gallon Heavy-Duty Pail Liners.
www.lime.org.uk, Bucket Trowel 7 inch, printed Feb. 4, 2005.
www.marshalltown.com, 7-1/2" (19.05cm) Bucket Trowel w/Wood, printed Feb. 4, 2005.

(Continued)

*Primary Examiner* — Dung Van Nguyen
(74) *Attorney, Agent, or Firm* — Santangelo Law Offices, P.C.

(57) ABSTRACT

A hand-held tool for removal and scraping of matter, such as mortar, drywall and the like from surfaces such as containers, buckets and the like, thereby perhaps salvaging the matter for reuse as well as salvaging the container. A hand-held tool may include, in the various embodiments, a curved blade having at least one straight side edge; a flat bottom edge; and a top surface that may be used a handle, a hanging shelf, and perhaps even reinforcement of the integrity of a blade. A hand-held tool may be made of stainless steel, galvanized metal, plastic and the like.

38 Claims, 10 Drawing Sheets

OTHER PUBLICATIONS www.demandproducts.com, EIFS Bucket Trowel, printed Feb. 4, 2005.
www.diytools.co.uk, Bucket Trowel, printed Feb. 4, 2005.
www.bucketrack.com, "Bucket Rack",printed Mar. 4, 2005.
www.bucketbrake.com, "Dreaded job inspires handy new invention", printed Mar. 4, 2005.
www.freundcontainer.com, Open Head Pails, printed Mar. 4, 2005.
www.demandproducts.com, Trimixx Commercial-Duty, 3-Position Production Mixer, printed Mar. 4, 2005.
www.demandproducts.com, Bucket Gripper, printed Mar. 4, 2005.
www.freundcontainer.com, 5 Gallon Heavy-Duty Pail Liners, printed Mar. 4, 2005.
www.freundcontainer.com, Colored or Silk Screened Open Head Pails, printed Mar. 4, 2005.
www.boatersworld.com, Boone—Fast Feat Bucket Board #200, printed Mar. 4, 2005.
www.dcproductsllc.com, Bait Bucket Board, printed Mar. 4, 2005.
www.marketlaunchers.com, The Bucket Pal bucket attachment for carrying pole-handled tools and fishing poles, printed Mar. 4, 2005.
www.bontool.com, Bon Bucket Trowel, printed Mar. 4, 2005.
www.lawsonsp.com, Ink Tools for Screen Printing Ink; Ink Spatulas; Goop Scoop Scraper; Slick Scoop; Bucket and Pail Openers, printed Mar. 4, 2005.
Tool Pouch; 5-Gallon Bucket; Tools He'll Use Combo; Real Deal; Value 5-Gallon Bucket Tool Organizer; Bucket Dolly, printed Mar. 4, 2005.
www.duluthtradine.com, Product Listing, printed Mar. 13, 2005.

* cited by examiner

EFFICIENT, HAND-HELD MATTER REMOVAL SYSTEMS

This application claims the benefit of U.S. Provisional Application No. 60/663,005, filed Mar. 18, 2005, hereby incorporated by reference herein.

BACKGROUND OF THE INVENTION

Generally, the present invention relates to hand-held systems for the removal of matter from surfaces. Specifically, the present invention relates to hand-held scrapers and perhaps even a scoop which can move, push, or perhaps even remove matter from a surface, such as a container or perhaps even a bucket and the like.

The removal of all kinds of matter from surfaces, such as containers, buckets and the like are commonly used in the construction industry, among others. Common examples of construction matter may include drywall, adhesives, mortar, ceramics and the like. Typically these materials may be applied to a floor or other part of a building by manually removing matter from a container with a hand tool and then applying the matter in a desired application. It may be unlikely that all of the matter can be removed from its container since the tools, as currently existing, may not sufficiently access all of the matter in the container. The remaining matter may be discarded, thus increasing costs of materials and increasing waste. The remaining matter may even be left to harden and dry to its container making it difficult, if not almost impossible, to remove from the container, thus causing waste of the matter and perhaps even leaving container itself unusable. Once matter may adhere to a container, the container may be thrown out which causes environmental waste as well as increased costs. It may have been an assumption in the field that if you did not clean your containers when wet, you pretty much may have had to throw them away.

Various designs for scraper and cleaning tools have been used, such as in U.S. Pat. No. Des. 368,344 to Hansen and U.S. Pat. No. Des. 388,569 to Israel. Many of the existing scraper and cleaning tools have an elongated handle separate from a blade such as shown in U.S. Pat. No. 405,661 to Erickson; U.S. Pat. No. 2,807,168 to Wipf; U.S. Pat. App. Pub. No. 2004/0068819 to Nistico; U.S. Pat. No. 4,627,128 to Shea; U.S. Pat. No. 6,393,650 to Gerakos; and U.S. Pat. No. 5,491,868 to Baggenstos. Elongated handles such as shown in these references, may not adequately provide maneuverability of a blade for removal of matter from surfaces. Some tools may have a lower blade member such as shown in U.S. Pat. No. 5,706,546 to Utley; a base as seen in U.S. Pat. No. 5,799,997 to Lehn et al.; and a curved edge as shown in U.S. Pat. No. 4,987,635 to Young. A lower blade member may prevent adequate access to sides of a container and may only provide scooping uses.

Other designs include U.S. Pat. No. 5,201,121 to Heiberg, which provides a kitchen implement including a flat sheet having a cutting blade at one longitudinal end, a beaded handle at another longitudinal end, side edges having projecting teeth and a mounting opening through the sheet. Also, a hand tool, shown in U.S. Pat. No. 5,325,643 to Faldetta, includes a handle and two different sized blade members.

There are problems, perhaps even unrecognized problems, that may be associated with the present scraper, cleaning tools, and the like. The present tools may not adequately remove wet matter from its container for use. The present tools may not adequately remove dried matter from its container for cleaning. Thus, there remains a continuing need in the art for improved hand tools and methods of using hand tools with matter in containers. In particular, there remains a continuing need in the art for systems and apparatus which can remove matter, such as wet and dry matter from containers as well as providing a tool that is simple, portable and easy to use while saving time, money and perhaps even help with waste reduction. Surprisingly, the references herein described and existing may not be adequate to fulfill the existing needs.

SUMMARY OF THE INVENTION

Accordingly, the present invention provides, in embodiments, a tool, such as a hand tool which can quickly and efficiently remove material from a surface or container such as but not limited to the sides and bottom of a bucket.

It is an object of the present invention, in embodiments, to provide a hand tool which may efficiently clean matter from containers such as buckets.

It is another object of the present invention, in embodiments, to provide a tool that can remove wet matter from surfaces as well as remove dry matter from surfaces. Dried matter, partially dried matter, and the like may occur when matter in a bucket may sit overnight or longer. A tool adept for use with wet and dry matter may provide an environmentally friendly tool which may preserve dirty buckets where they normally may have been thrown out and may even reduce waste of the matter.

It is yet another object of the present invention, in embodiments, to provide a tool which may allow utilization of invention to push matter drying on sides of a container such as a bucket down into the wet matter. This may save money and time by using all the product in the bucket and may even result in fewer re-mixings.

It is another object of the present invention, in embodiments, to provide a fast, reliable, durable and perhaps even long-lasting tool for removal of matter from surfaces, containers and the like.

It is an object of the present invention, in embodiments, to provide a tool which can clean the sides of a bucket as well as can convert into a scoop for removal of matter. Specifically, it is a goal of the present invention to provide an effective scoop of matter for removal.

It is yet another object of the present invention in embodiments, to provide a tool which can be placed on a rim of a bucket. It may even provide, in embodiments, a hand tool which can be stored on a rim of a bucket while still allowing a container cover to be placed on a container.

It is yet another object of the present invention, in embodiments, to provide a hand tool having a reinforced top surface which may be used as a handle, hanger, and perhaps even to maintain the integrity of a contour of a plate.

It is another object of the present invention, in embodiments, to provide a tool that may prevent stacked containers from sticking together such as with an easy bucket unstacker.

Naturally, further objects, goals and embodiments of the inventions are disclosed throughout other areas of the specification claims.

The embodiments of the present invention as herein discussed provides a solution to long felt and unsolved needs. Results achieved with the various embodiments of the present invention, individually or perhaps even in combination, may provide systems which are new, unexpected and superior to existing ideas. Synergism of the embodiments may also provide novel, nonobvious and patentable features.

DETAILED DESCRIPTION OF THE PREFERRED EMBODIMENTS

Figure 1:
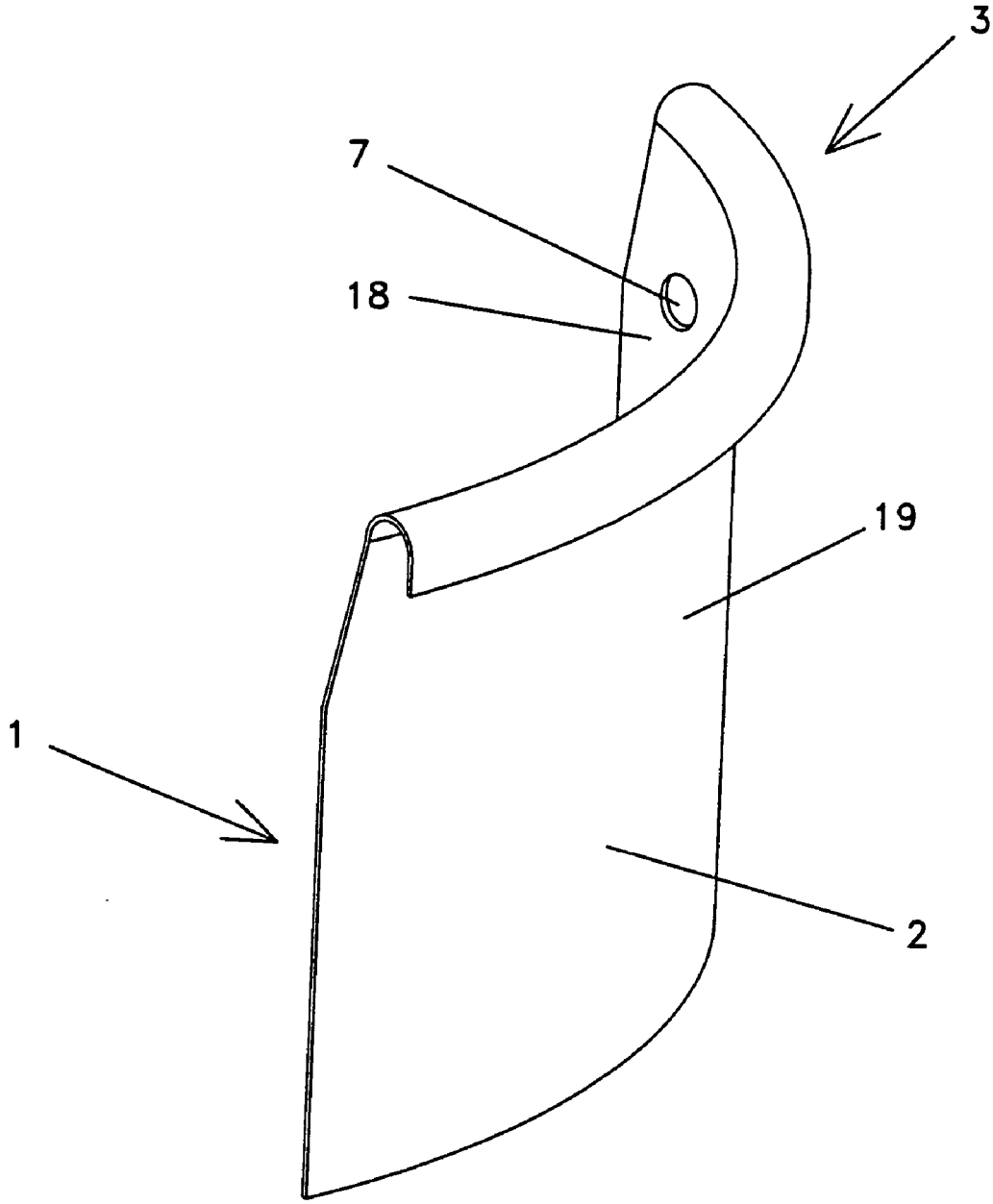
FIG. 1 shows perspective side view of a hand tool having a curved plate, a top surface and a hanging hole in accordance with embodiments of the present invention.

As mentioned earlier, the present invention includes a variety of aspects, which may be combined in different ways. The following descriptions are provided to list elements and describe some of the embodiments of the present invention. These elements are listed with initial embodiments, however it should be understood that they may be combined in any manner and in any number to create additional embodiments. The variously described examples and preferred embodiments should not be construed to limit the present invention to only the explicitly described systems, techniques, and applications. Further, this description should be understood to support and encompass descriptions and claims of all the various embodiments, systems, techniques, methods, devices, and applications with any number of the disclosed elements, with each element alone, and also with any and all various permutations and combinations of all elements in this or any subsequent application.

Matter, substances, even mixing substances and the like to be removed from surfaces, containers and the like may include but are not limited to adhesives, ceramics, floor mastics, sheet rock components, grout, mortars, drywall, paint, dirt, thin-set, thin-set with grout, mud, earth, drywall compound, wet matter, dry matter, combinations of these, and the like. Matter may include physical or perhaps even corporeal substance in general, whether solid, liquid, or the like. Surfaces and containers from which matter may be removed may include anything that contains or can contain something such as but not limited to buckets, five gallon buckets, three gallon buckets, ten gallon buckets, cans, cartons, boxes, crates, trash cans, pots, containers, pails, paint containers, bottles, tubs, circular shaped objects, non-circular shaped objects and the like. The discussion herein describes the use of various embodiments of hand tools with a bucket (25) and container as non-limiting examples. Accordingly, it is meant to be understood that other surfaces of items may be used with the various tool embodiments as described herein.

The present invention provides, in embodiments, methods for removal of matter as well as hand-held matter removal apparatus. A hand tool, as described herein, may be used for many different scenarios such as but certainly not limited to tradespeople, construction trade workers, drywallers, masons, tilers, landscapers, food industry, commercial food industry, cafeteria, users of mastics in large quantities such as carpeting and the like, painters, do it yourselfers, agricultural workers, gardeners, farmers, feed, fertilizer, roofers, tars, hospital industry, inking industry, printing venues, custodial workers, janitorial workers, waxes and the like.

In embodiments, a hand tool (1) may include a plate (2), a contoured plate, or perhaps even a curved plate. A plate may include a sheet such as but not limited to a thin, flat sheet, or perhaps even a curved sheet or piece of metal or other material which may be of a uniform thickness. A contour or perhaps even an arc (20) of a plate may match an inside arc of a bucket or may even be a shape substantially similar to an arc of a bucket. A curved plate may be a plate having continuously bending lines perhaps even without angles. In embodiments, a curved plate may have a shape that may be substantially similar to an arc of a five gallon bucket, three gallon bucket, and the like. A plate may be any shape including but not limited to rectangle, square, rectangular curved plate, square curved plate and the like. In embodiments, a plate may be a curved plate such that it may be transversely arced to define a concavo-convex shape which may approximately conform to a peripheral interior of a bucket. A plate may include, in embodiments, an inner surface or perhaps even an inner concave surface and may include an outer surface or perhaps even an outer convex surface. For example, a hand tool, may have a corresponding curvature to a bucket curvature, in embodiments.

In non-limiting embodiments, a plate may be, for example, about 7¼ inch, about 7½ inch or the like in length and about 4½ inches, about 4¼ inches or the like in height. This may vary by a few inches. Of course all sizes, lengths and heights are possible and are meant to be included in the disclosure of the present invention. In embodiments, an overall size of a tool may fit into a toolbox and it may even be desirable to provide a size of a tool which may be easy to hold and easy to maneuver.

Figure 2:
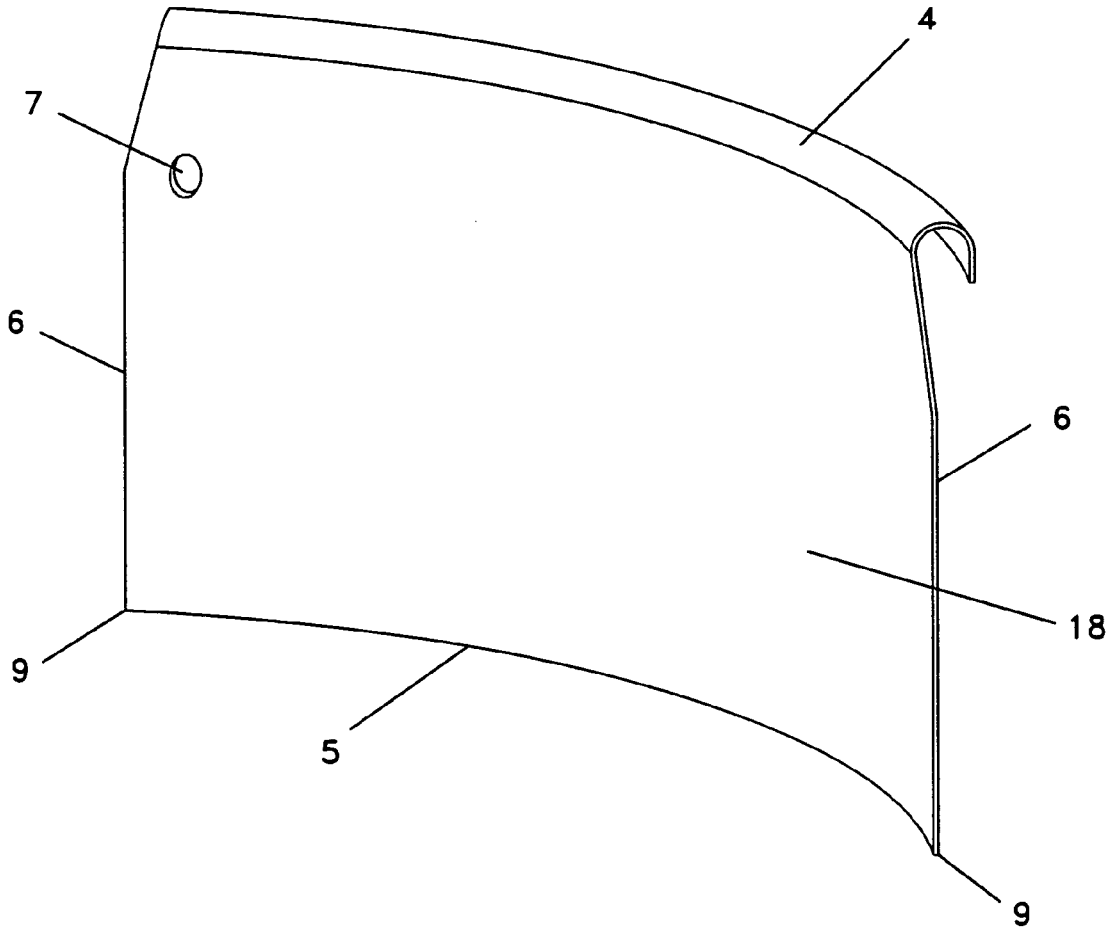
FIG. 2 shows a perspective back view of a hand tool having a curved plate, handle, side edges and bottom edge in accordance with embodiments of the present invention.
Figure 3:
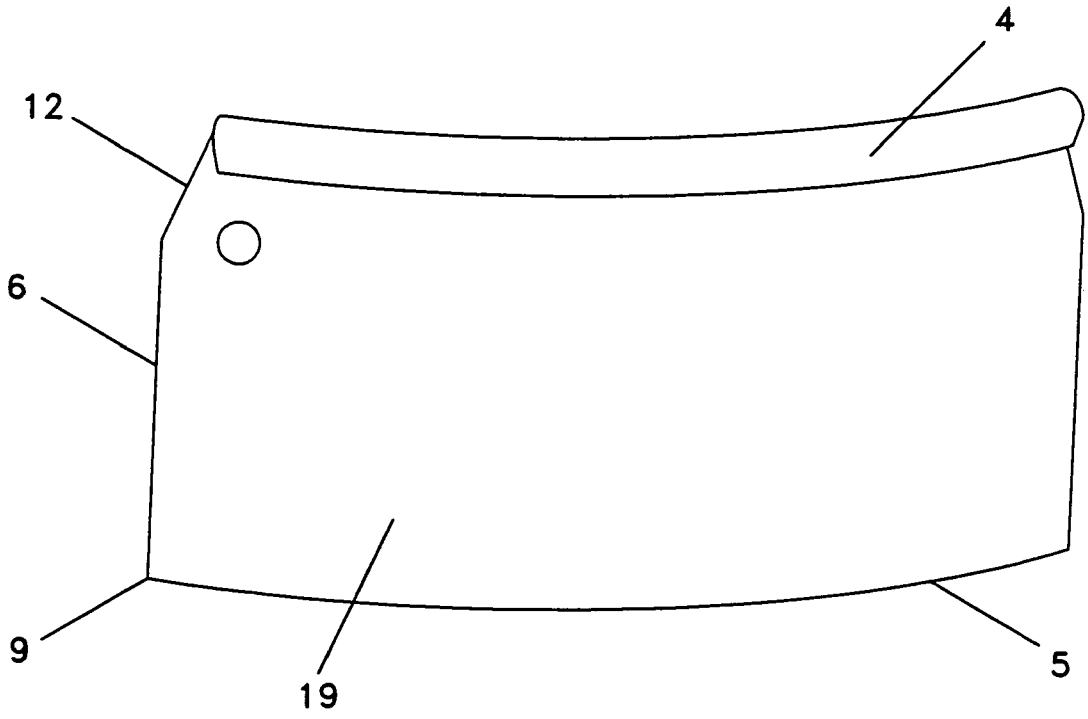
FIG. 3 shows a front view of a hand tool in accordance with embodiments of the present invention.
Figure 4:
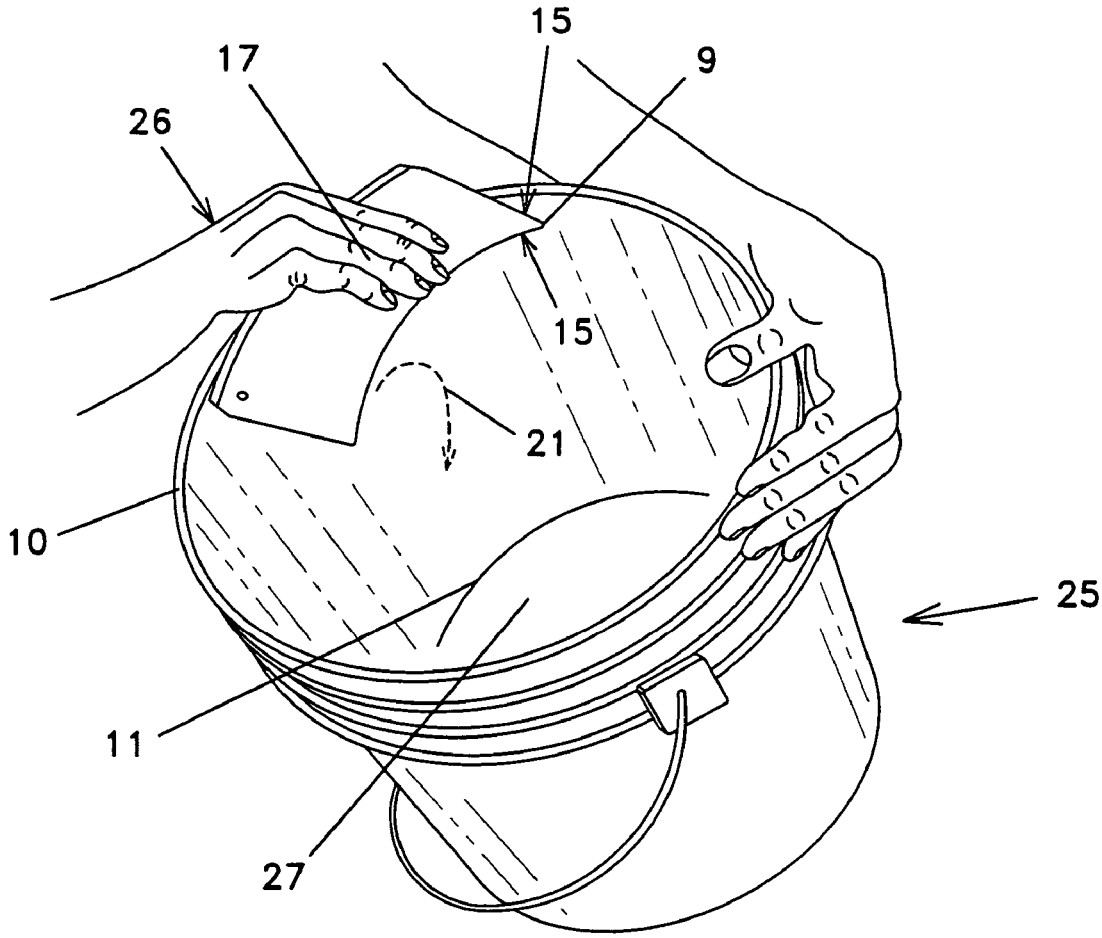
FIG. 4 shows an example of a user holding a hand tool in accordance with embodiments of the present invention.

The present invention may provide, in embodiments, a top surface (3) of a plate. A top surface may include a handle, handle-hanger element, a reinforced top surface, an edge, a flat edge, and the like in various embodiments. It may be desirable to reinforce a curved plate with a handle that may be longitudinally located on a top surface of a curved plate. In embodiments a top surface (3), may maintain integrity of a plate or perhaps even a contoured plate. A top surface may include, but is not limited to, a rim, lip, outer edge, straight edge and the like at a top of a plate. In embodiments, a top surface (3) may include a handle for a user to grasp during use of a hand tool. A handle may be longitudinally located on a top surface of a curved plate. By longitudinally it may be understood that a handle element may extend in the direction of the length of a top of a plate; such as running lengthwise. In embodiments, the present invention may provide a handle-hanger element (4) longitudinally located along a top of a curved plate. A handle-hanger element (4) may have a curved top surface, such as an example as shown in FIGS. 2 and 3. A handle-hanger element which may be used to hang a plate, or curved plate, may also function as a handle. A curved top surface may have an inverted u-shaped surface. In non-limiting embodiments, a handle-hanger element may form a gap such as but not limited to about ⅜ inch, about a ½ inch, greater than about ¼ inch or the like sized gap. Of course any type of handle-hanger element or perhaps even an outer edge may be formed. A handle-hanger element may be capable of hanging over a rim (10) of a bucket. Accordingly, in embodiments the present invention may provide hanging a curved plate on an upper surface of a bucket with a handle-hanger element. In other embodiments, the present invention may provide hanging a handle over a rim (10) of a container as can be understood from FIG. 4. In embodiments, a handle-hanger element or perhaps even a handle may have rounded corners and may even have about ¼ inch radius edge at rounded corners.

As discussed, a top surface (3) such as a lip of a hand tool may be used to conveniently hang a plate on a rim of a bucket while in transport, storage or perhaps even when not in use. In embodiments, a hand tool may hang on a rim of a bucket while allowing a top or cover of a bucket to be substantially secured onto a bucket. Since a top surface of a hand tool may lessen some sealing capabilities of a cover to the bucket, a perfect seal may not be achieved. Yet, some sealing may be capable and matter inside a bucket may remain wet and useable.

In other embodiments, a handle-hanger element may be placed on a rim of a bucket and at least one additional bucket may be stacked into a bucket. Surprisingly, removal of a stacked bucket may be easier when a hand tool may be hanging on a rim of a lower bucket. A handle-hanger element may prevent the buckets from sticking together.

Figure 6:
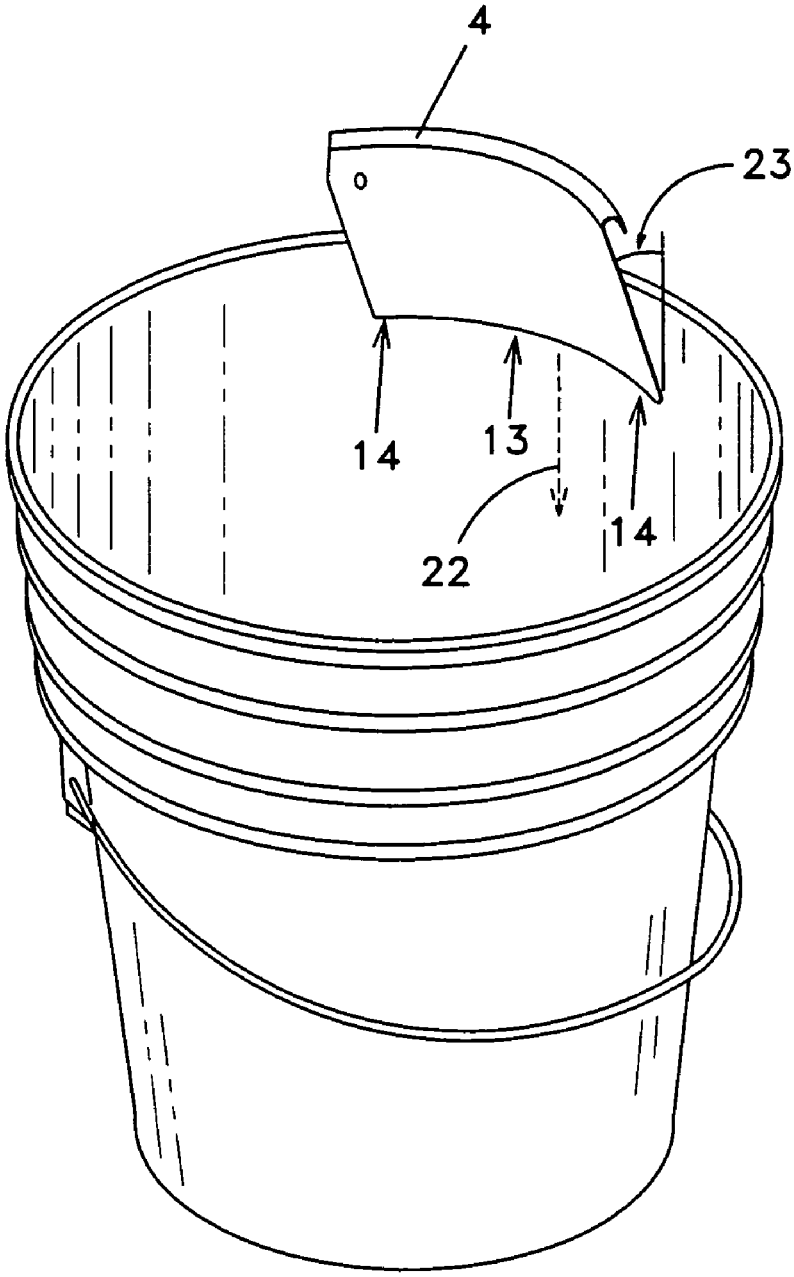
FIG. 6 shows a hand tool with respect to an inside of a bucket in accordance with embodiments of the present invention.

In embodiments, the present invention may provide an easy bucket unstacker. An easy bucket unstacker may include a curved plate having a handle-hanger element (4) as discussed herein and an example is shown in FIGS. 2 and 6. Embodiments may include stacking an additional container such as a bucket, box or the like inside of a container when a hand tool having a handle may be hanging over a lip of the container, or perhaps even a rim of a bucket. As can be understood from FIG. 6, a tool may be placed in a vertical position, moved down into a bucket so that a handle-hanger element (4) may hang on a rim (10) of a container. Because the hanging hand tool may prevent the additional container to fit closely into a bottom container, when the additional container may be removed, it may be easily unstacked from a container.

In other embodiments, a top surface of a hand tool that may be a curved top surface may include a slight taper inwards, such as an example shown in FIG. 3. In embodiments, the present invention may include preventing matter build up in a hand tool, such as near a top surface, in a handle, and the like during use. This may be helpful when scooping with a hand tool as described herein. At least one tapered element (12) may help to prevent impedance with a scooping action in a bottom of a bucket when removing materials. As a tool may be used to scoop the contents of a bucket out, matter may become lodged at a top surface of a plate. A tapered element (12) may be located on at least one side edge of a plate, perhaps on at least one straight side edge and may even prevent a hanger portion or the like from loading up with material when scooping. A tapered element may be about 10 degrees, may be about 15 degrees, may be between about 5 degrees and about 15 degrees, may be between about 5 degrees and about 20 degrees, may be at least 5 degrees and the like. These are merely examples of angles and are not meant to limit the scope of this application. Of course, other angles may be used and all angles are meant to be included in this disclosure.

A bottom edge (5) of a hand tool may be a flat bottom and may even include a straight edge. In embodiments, a flat bottom edge may include a tapered edge, a sharp edge or the like. A flat bottom edge of a tool may fit flat perhaps even lying wholly against a surface such as a bottom surface, a bottom surface of a bucket, a horizontal surface and the like which may serve to loosen material for example, in a bottom of a bucket. A flat bottom of a plate may include an edge that may be horizontally level and may even include level without unevenness of a surface. In embodiments, a curved plate may include a flat bottom edge, where the bottom surface may be curved, yet an edge may be flat.

Embodiments of the present invention may include using at least one end point of a curved plate to remove matter such as wet material or even dried material from a surface. At each of the ends of a bottom of a tool, there may be an end point (9), which may assist in the removal of matter from a surface. In embodiments, an end point may include a 90 degree angle end point. A right angle end point may have edges that are slightly dulled for safety while still maintaining edges that allow matter removal. An end point may include a sharp edge, in embodiments. A 90 degree angle end point may be provided for scraping the corners (11) of the bottom of a bucket as well as may assist in chipping away at matter, such as hardened matter, on sides of a bucket. During use of a tool and at least one end point, at least one dynamic contact point may be established. Contact points (15) on a plate during use with end point may include surfaces on a bottom edge of a plate or perhaps even surfaces on a side edge of a plate, as an example shown in FIG. 4.

In embodiments, a hand tool may include side edges (6) having at least one straight side edge. A straight side edge may include a non-toothed surface, and may even include an end without a bend, angle, or perhaps even a curve. In embodiments, both side edges of a tool may be straight resulting in two straight side edges. Side edges may be sharp, substantially sharp, or perhaps even slightly dulled or at least one dull side for safety while still maintaining edges that may allow matter removal. Side edges of a hand tool may be used for scraping and perhaps even scooping matter from a surface. Embodiments may provide using at least one of a tool's edges, which may include at least one straight side edges, a side edge, a flat bottom edge, a bottom edge, or the like to remove matter from a surface such as a container, bucket, pot, tub and the like.

In other embodiments, the present invention may provide a hanger hole (7) such as an example shown in FIGS. 1 and 2. A handy hanging hole may allow for storage of a hand tool perhaps by hanging a curved plate over an attachment element. A hanger hole may be within a curved plate and may even be located in an upper corner of a curved plate. A hand tool may be attached to an attachment element which may include but is not limited to a nail, peg, string, loop and the like with a hanger hole.

A hand tool, for example, may be used during a project, such as when drywalling, using acoustics, or perhaps even when applying mortars and the like, when matters may ordinarily build up and dry on a side of a bucket, to push a matter down into the "wet" matter and thereby may prevent loss of product and even may provide less remixing. In effect, the present invention may provide an environmentally beneficial tool in that it may save waste and the like. This may save money and time. In other examples, used matter that has been left to dry, including but not limited to drywall, mortar, cement and the like may be removed from a bucket with tools according to the various embodiments described herein.

Figure 7:
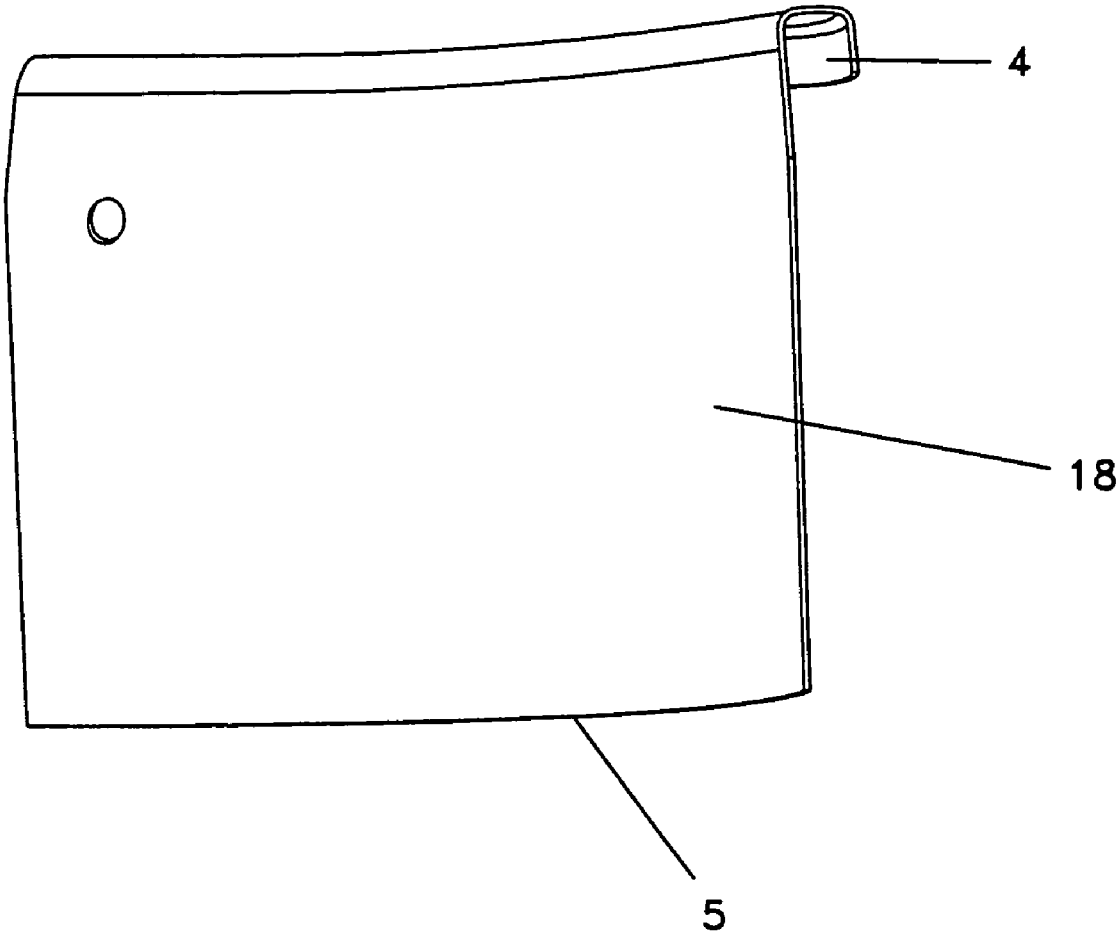
FIG. 7 shows a perspective back side view of a hand tool in accordance with embodiments of the present invention.

In embodiments, the present invention may provide methods and systems for removing matter from surfaces. This may include, in embodiments, providing a curved plate to remove matter from an inside of a container such as a bucket, five gallon bucket, three gallon bucket and the like. For example, a user may propel matter from a top of a bucket rim to a bottom of bucket with a hand tool with manual grasping of a hand tool for manipulation. In embodiments, a user may hold a curved plate with their fingers (17), perhaps four fingers, along an inner surface (18) of a curved plate, a user's thumb (16) along an outer surface (19) of a curved plate and a user's palm cupping a top surface of a curved plate, as shown for example, in FIGS. 1, 6 and 7. Embodiments may provide holding a curved plate with a user's palm cupping a handle longitudinally located on a top surface of a curved plate. When a user may grasp a hand tool their inside palm and perhaps even a crotch of thumb (between the thumb and pointer finger) may cup a top surface of a hand tool. Cupping a plate may include a user forming a cup-like shape (26) with a hand as shown for example in FIGS. 4 and 5, and may even include applying force to plate where a top surface or even a handle hits a palm of hand. A user may hold a container such as a bucket, pot, tub or the like, with at least their free hand and may even use their feet, legs, knees and the like to secure the container. The present invention may provide, in embodiments, using at least one of a tool's edges to remove matter from a surface. This may include slicing an edge of a plate between matter and an inner side surface of a bucket.

A user may push matter towards a bottom of bucket with motions that may work towards oneself or perhaps even towards a body of a user. This may be explained in FIG. 4 and may allow a user to provide appropriate force to a hand tool. After sides of a bucket may be cleaned, the matter may be at the bottom of the bucket. A couple of turns, circular motion, movement or the like on a bottom of a bucket with a tool, using a bottom portion of a tool such as a flat portion of a tool, may loosen matter on the bottom of a bucket. A bucket may be turned onto its side and the user may use a hand tool as a scoop for removing the matter. A side edge of a hand tool may be used as a scoop which may allow matter to be pushed onto a convex shaped region of a hand tool allowing the matter to be removed from the bucket to another location. While a tool may not remove all of the matter, a towel, rag or perhaps even a damp towel may be used to wipe out any excess matter.

When using a hand tool with matter, in embodiments, the present invention may provide holding a hand tool, as previously described, with fingers, perhaps four fingers on an inner surface and a thumb on outer surface of a curved plate. This hand position may also be used during any movement, uses or the like with a hand tool and of course, other hand positions may be used. A hand tool may be engaged with an inside surface (24) of a bucket, as shown as an example in FIGS. 4, 5 and 6. Embodiments may include placing at least one of a plate's edges, such as but not limited to a bottom edge, in contact with an inner side surface of a bucket to temporarily create at least one dynamic contact point. In other embodiments, the present invention may provide contacting a curved plate with a surface, perhaps even with an inner side surface of a bucket, with at least one dynamic contact point during use with a curved plate. Continuous change of a contact between a surface of a bucket and a curved plate may occur. In embodiments, the present invention may provide for constantly changing the correspondence of the angles of curvature of a tool and a bucket side to achieve the desired effect.

At least one dynamic contact point between a curved plate and a surface may include, but is not limited to at least part of a flat bottom edge of a curved blade, at least part of a bottom edge of a curved blade, at least part of a straight side edge, at least part of a side edge, near a middle or even a center of a flat bottom edge of a curved blade, and near each corner of a flat bottom edge of a curved blade, any exterior edges of a tool, any surface of a tool and the like. A hand tool may be moved along a surface thereby providing a dynamic contact point in which a connection between at least a curved plate and a surface may continuously change. A plate and a surface may remain connected yet the point of contact may change as a tool may be moved along the surface. Embodiments may provide continuously changing at least one dynamic contact point between an inner side surface of a bucket or perhaps even a bottom of a bucket and at least one edge of a curved plate. A dynamic contact point may be temporary in that a contact point may be disconnected such as when a user may remove the tool from a surface or perhaps even during use with a plate. In embodiments, as a user may move a plate towards a bottom of a bucket, a point of contact between a tool and a surface may change and a tool may be rotated with a sideways and perhaps even downward motion perhaps resulting in a circular motion (21) as an example can be seen in FIG. 4. This may include an almost spiral motion.

When holding a hand tool and placing at least part of a bottom edge of a curved plate against a bucket surface, a user may have to make some room for their thumb so that they do not hit their thumb with a container. When making room for a thumb, an angle of inclination, or perhaps even a angle (23) of tilt of a hand tool may be provided as an example can be seen in FIG. 6. This angle may change during use of a tool. In embodiments, the present invention may include applying user force to a handle of a curved plate which may allow user force to be applied at at least one dynamic contact point. A curved plate may then be moved between matter and an inner side surface of a bucket which may even provide removal of the matter attached to an inner side surface of a bucket. Embodiments may include scraping an inner side surface of a bucket with a curved plate towards a bottom of a bucket. For example matter, may be pushed in a downward motion, such as a straight downward motion (22) from a top to a bottom of a bucket. Two points of contact may be applied at this point, in embodiments. As another example, matter may by pushed by applying force to a curved plate in a circular movement and perhaps even in a downwards movement. This movement may be repeated over an entire inside surface of a bucket and may even include removing user force from a top surface or perhaps even a handle of a curved plate which may remove user force from the at least one dynamic contact point. A user may then reposition at least one of the edges of a curved plate with an inner side surface of a bucket. If a build up of matter occurs on a hand tool, it may be desirable to tap a hand tool to remove the scraped matter. Once the sides of a container are clean, the bottom matter may be reused or even removed from the container. A bottom edge of a hand tool may be placed flat onto the bottom of a bucket and force may be applied to a top surface while moving matter with a flat bottom to scrape matter from the bottom of a bucket. The position of a hand tool (1) as shown in FIG. 1, may be placed on a bottom of a bucket, such as where a bottom edge of a tool may lay flat against a bottom of a bucket. Movement may be in a circular direction, a planar direction, or the like while perhaps a bottom edge of a plate may remain flat against a bottom of a bucket during the movement. Matter may be moved to one side. At least one end point or perhaps even a 90 degree angle end point of a hand tool may be used to remove matter from crevices or even corners (11) of a bucket, in embodiments.

Figure 8:
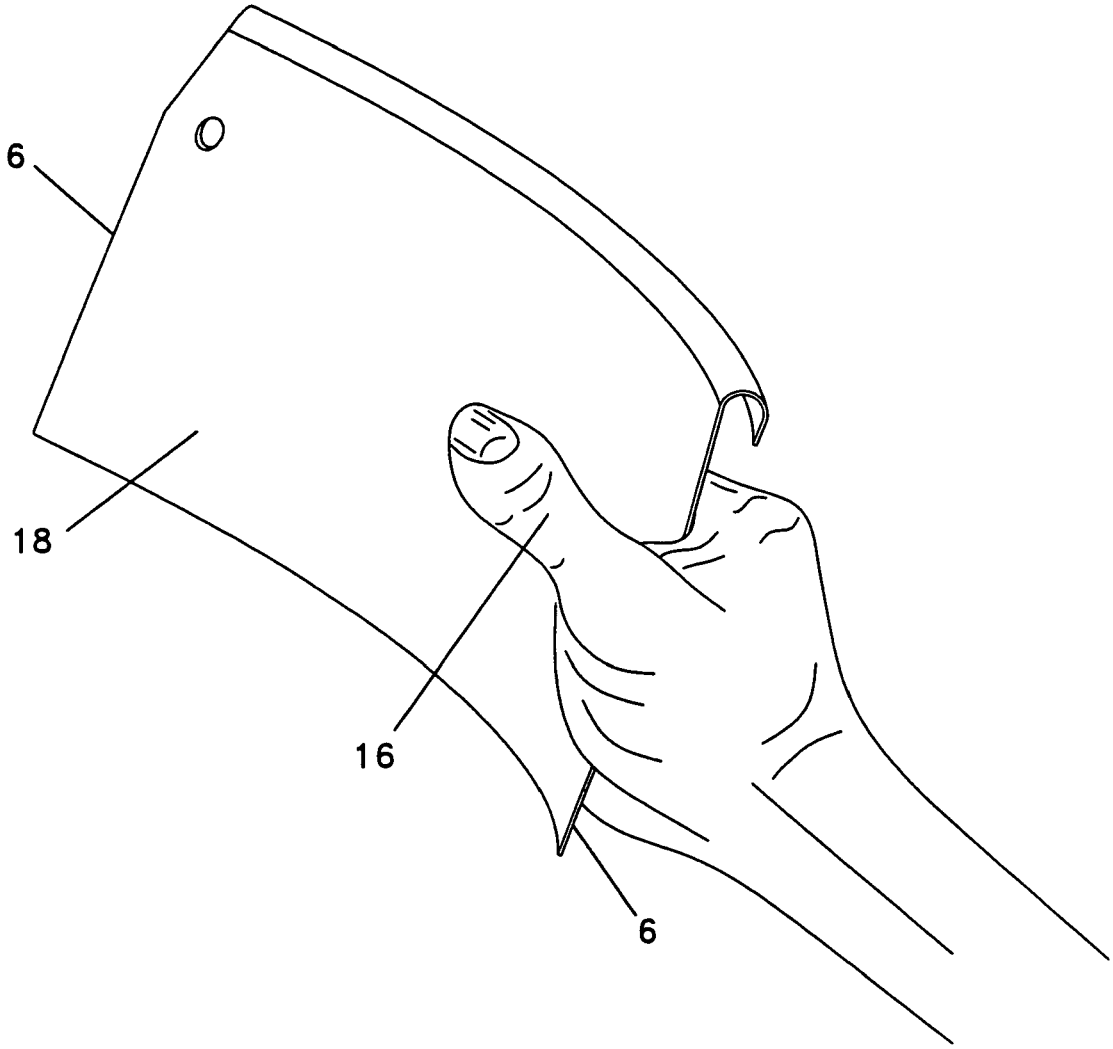
FIG. 8 shows a user holding a side of hand tool in accordance with embodiments of the present invention.
Figure 9:
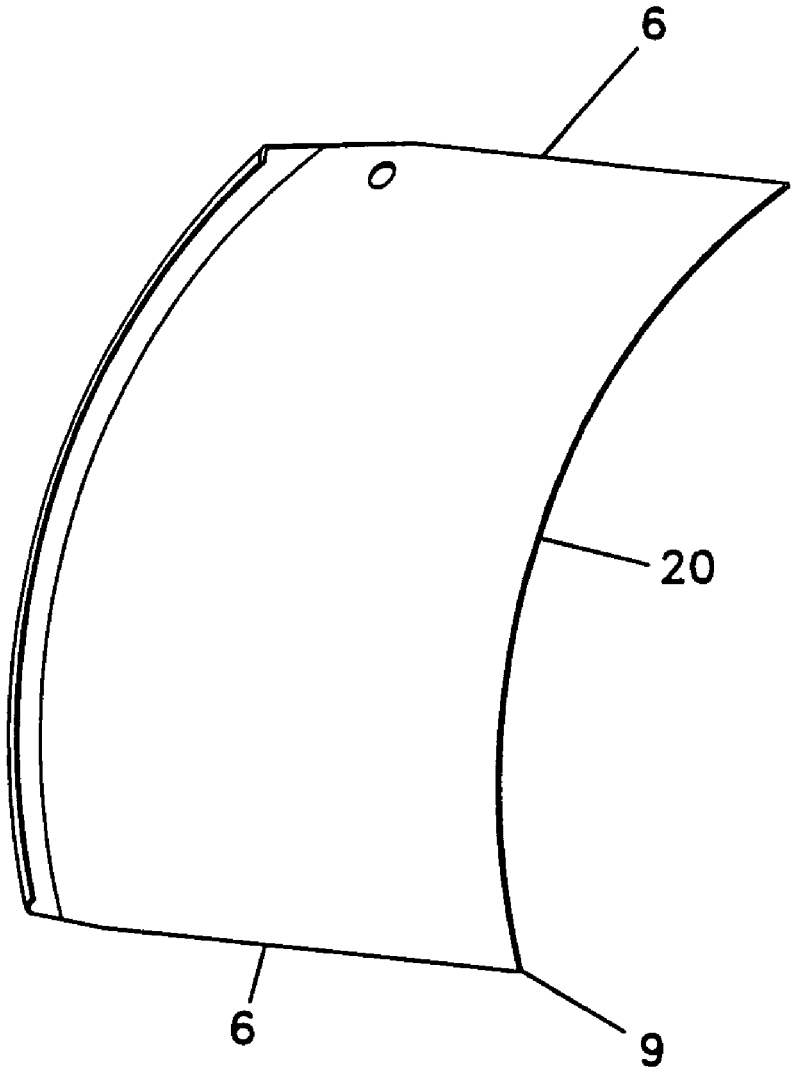
FIG. 9 shows a perspective front view of a hand tool on its side in accordance with embodiments of the present invention.

During use of a curved plate, the present invention may provide, in embodiments, changing a user's hold of a curved plate. A user may rotate a hand tool position by placing a user's fingers, for example, four fingers along an outer surface (19) of a curved plate and a user's thumb along an inner surface (18) of a curved plate, as an example can be seen in FIG. 5. This hand position may also be used during any uses with a hand tool. To create a scoop from a hand tool, a user may, in embodiments, hold a curved plate with a user's fingers along an outer surface (19) of a curved plate, a user's thumb along an inner surface (18) of a curved plate, and a user's palm cupping a straight side edge as an example may be seen in FIGS. 8 and 9. A user may turn a bucket onto its side and scoop out matter from a bottom of a bucket by holding a tool at a side edge and may scoop matter onto a curved plate using an opposite side edge. Specifically, in embodiments, a user may lay a side edge of a plate flat along a bottom of a bucket and may push the side edge along the surface allowing matter to load up into the plate.

A hand tool, in embodiments may be an adept tool which may be capable of use with a variety of different matters as well as various states of matters such as but not limited to wet, dry, and the like. It may clean dried, hardened matter as well as wet, soft matters from surfaces. While a tool may be capable of removal of wet matter from surfaces, such as but not limited to drywall mud, paint and the like, it may also be capable of removal of dry matter from surfaces, such as but not limited to thin-set, drywall, grout, acoustic texture, paint, and the like. In embodiments, a tool may be capable of removal of thick matter and may even be capable of removal of up to about 1 inch or more of matter and perhaps even dried matter. It may be helpful to use at least one straight side edges and perhaps even an end point of a tool when scraping dry, partially dried, mostly dried or the like matter from a surface. Dried matter may include matter left to dry for about 24 hours, up to about 24 hours, up to about one month, up to about one and a half months and perhaps even longer.

With dried matter, it may be desirable to remove matter by starting at a top of a bucket. At a top, a user may apply force to a tool so as to scrap off the dry matter. In embodiments, it may be desirable to apply bursts of user force to a curved plate to remove matter from a surface. Bursts of force may include issuing force suddenly against a plate and surface. At least one, possibly two points of contact, or more may be present between a tool edge and a surface. The points of contact may bear a lot of pressure for effective scraping and a user may apply pressure at a pressure contact with the crotch of a user's thumb. Scraping matter at a top of a bucket may include using at least one side edge (6), a bottom edge (5) and perhaps even a 90 degree end point. It may take many short and repeated motions to loosen dried matter from a container surface.

The present invention, in embodiments, may include placing a flat bottom edge of a plate against an inner side of a bucket. As a curved plate may be tilted, it may include an angled position with respect to an inside surface a bucket. Embodiments of the present invention may include placing a curved plate in a steep angled position with respect to an inside surface of bucket. A steep angled position may include an angle (23) of tilt from a side of a bucket, an example is shown in FIG. 6, in which a plate may be in an almost vertical position, near vertical position or the like. A steep angle position may include, but is certainly not limited to an angle that is:

less than about 20 degrees;
less than about 15 degrees;
less than about 10 degrees; and
less than about 5 degrees.

Of course, other angles may be possible and all are meant to be included in this disclosure. A steep angled position of a curved plate may provide one dynamic contact point at a middle of a bottom edge of a curved plate (13) and an inside surface of a bucket.

In other embodiments, the present invention may include placing a curved plate in an angled position to create two dynamic contact points (14). These dynamic contact points may be near each end of a bottom edge of a curved plate and an inner side surface of a bucket. An angled position creating two dynamic contact points may include an angle (23) of tilt of curved plate from an inner side surface of a bucket and may include, but is certainly not limited to an angle that is:

greater than about 20 degrees;
greater than about 45 degrees; and
greater than about 60 degrees.

Of course, other angles may be possible and all are meant to be included in this disclosure.

It may be desirable to provide some flex in the tool material to allow adequate scraping and in embodiments, the present invention may include providing a flexible curved plate. A user may use their feet, knees, and perhaps even hands to hold a bucket steady during use of a tool. In embodiments, the present invention may provide alternating correspondence of a projected angle of curvature. At a top of a bucket, a user may apply a force concentration at a right angle edge of a tool, in embodiments. At or near a bottom of a bucket, a user may apply less force concentration for better coordination for cleaning and scooping. After pushing matter from sides of a bucket to a bottom, a user may rotate, perhaps even instinctively rotate the hold of a tool in an opposite fashion to create a scoop device.

In embodiments, the present invention may include a fast bucket cleaner tool which may provide fast removal of matter from a bucket. Surprisingly, in embodiments, a dirty bucket which may have taken a half hour to an hour or more to clean and perhaps even removal of matter with other tools, may be cleaned in less than about one and a half minutes, in about one minute and 15 seconds, or the like, with a hand tool in accordance with the various embodiments as described herein. Any amount of time is meant to be included in this disclosure, some examples may include, but it not limited to:

less than about 2 minutes;
less than about 1 minute 30 seconds;
less than about 1 minute 20 seconds; and
less than about 1 minute 15 seconds.

In embodiments, a hand tool may be made from at least one piece construction, two-piece construction or perhaps more. For example, embodiments may include providing a curved plate and a handle made of one-piece construction. Alternatively, embodiments may include providing a curved plate and a handle made of two-piece construction. In embodiments, a reinforced top surface may be shaped from a single piece of material into a curved shape or the like. A hand tool may even be made from a variety of materials such as but not limited to a rigid material, plastic, high density polyethylene ("HDPE"), polypropylene, galvanized metal, stainless steel, 1/16 inch plastic, 1/32 inch plastic, 3/32 inch plastic, 22 gauge galvanized metal, 24 gauge galvanized metal, 22 gauge stainless steel, 24 gauge stainless steel and the like. Of course, other materials may be used as well as various gauges and thicknesses of metals and all are meant to be included in this disclosure.

The present invention may provide, in embodiments, a tool made of a material that may allow for elasticity. Resilient flexibility may be desirable in a tool to assist in conforming to a surface and perhaps even maneuvering between matter and its attached surface during the scraping thereof. A thin plate, perhaps even having a tapered or sharpened edge may provide a tool that can slice through matter and a surface. This may include, in embodiments, 24 gauge stainless steel and the like. For example, a plastic version of a hand tool may include, in embodiments, a tapered bottom edge so as to provide adequate scraping capability. In embodiments, tools made of metals, such as stainless steel or the like, may from time to time get a dimple or perhaps may bend. Because of the durability of these materials, a user may simply be able to bend a tool back to its original shape such as with hands, pliers or the like.

Figure 5:
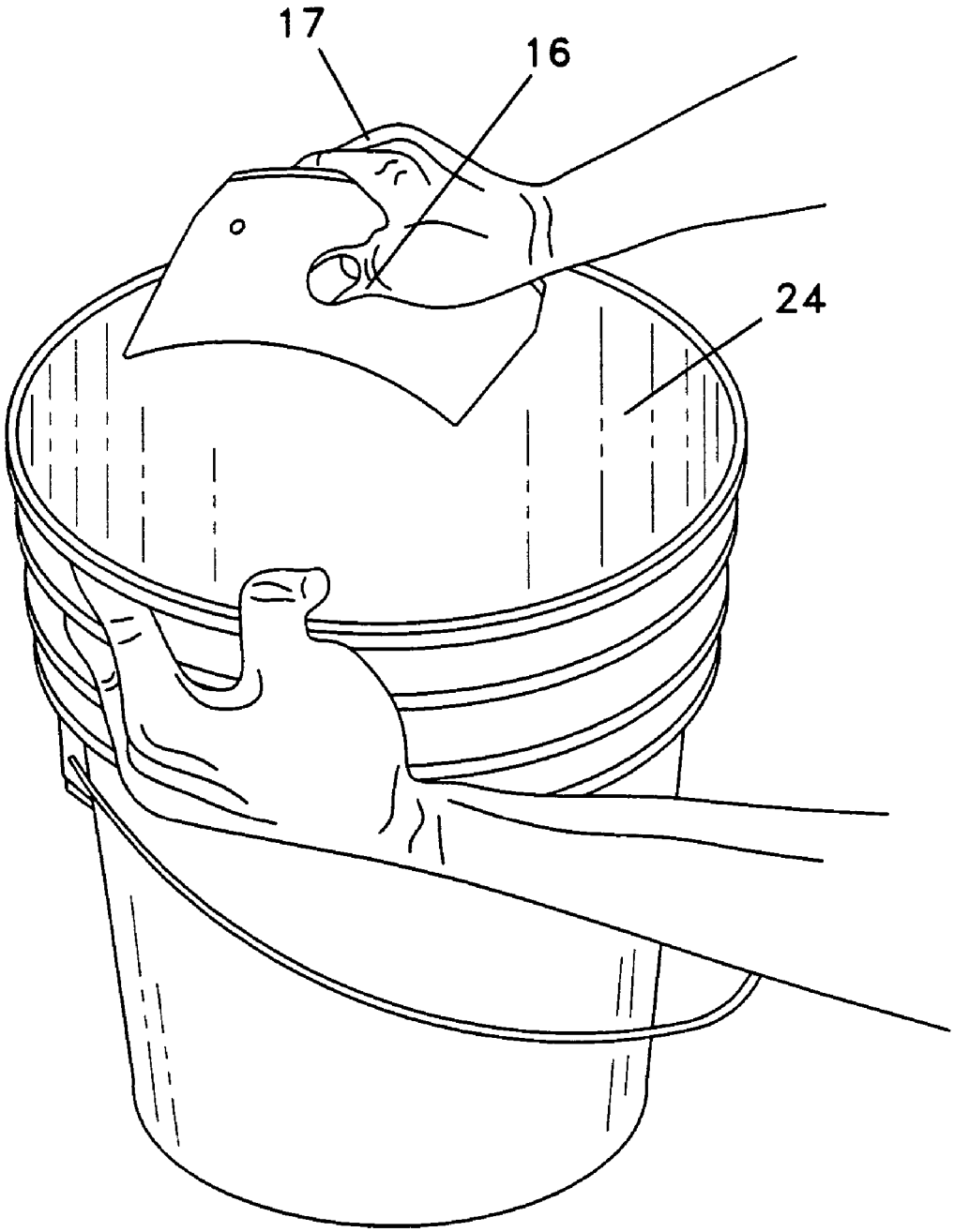
FIG. 5 shows an example of a user holding a hand tool in accordance with embodiments of the present invention.
Figure 10:
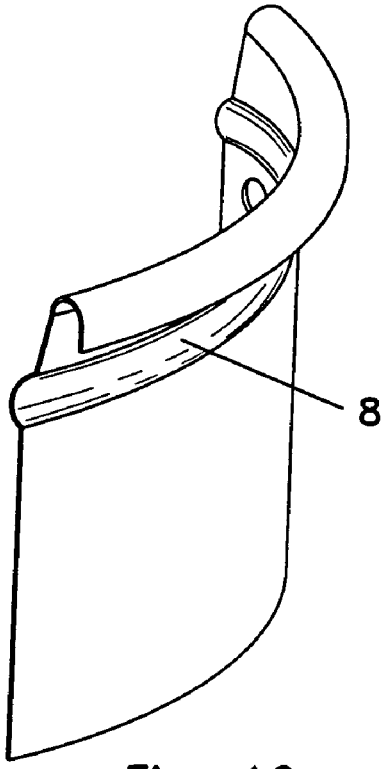
FIG. 10 shows an alternative embodiment of a side perspective view of a hand tool having knuckle room in accordance with embodiments of the present invention.
Figure 11:
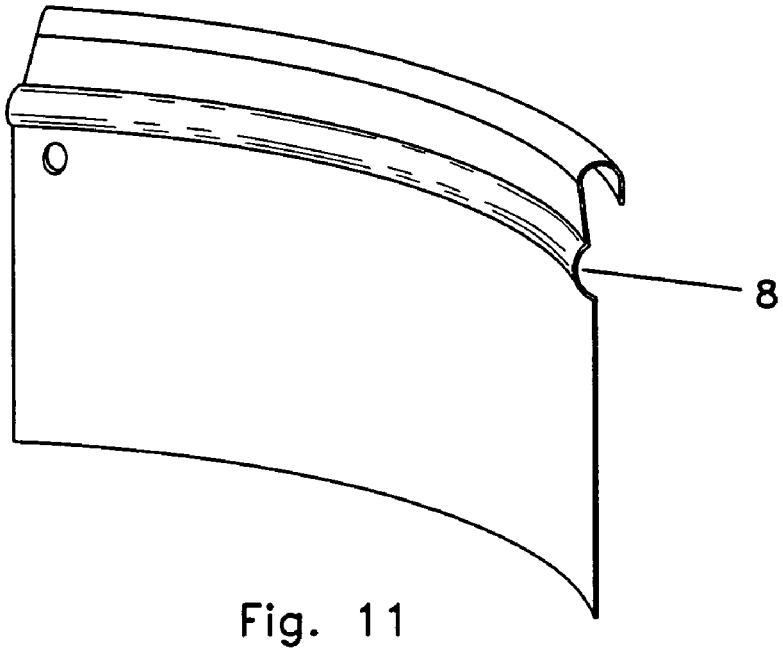
FIG. 11 shows in an alternative embodiment of a back perspective view of a hand tool having knuckle room accordance with embodiments of the present invention.

In alternative embodiments and as an example can be shown in FIG. 5, a user may hold a curved plate with their thumb on an inner surface and their fingers on an outer surface of a curved plate. While this hand position is certainly possible and is meant to be included within this disclosure, for inner side scraping such as at a top of a bucket, this hand position may not adequately allow efficient removal of matter. The present invention, in embodiments, may provide a tool having a shaped area (8) in a blade to allow for knuckle room, or even thumb room as an example can be seen in FIGS. 10 and 11. When holding a tool, the knuckles or perhaps even a thumb of a user may be susceptible to contact with the surface which may even cause injury. A user may place their hands on a hand tool having a shaped area so that the knuckles or perhaps even a thumb, depending on a particular hand placement, can be shielded, or somewhat shielded from contact with a surface during use.

In yet other embodiments, the present invention may provide for a hand tool having a frictional element on at least one surface of a plate to which a user may engage when holding and using a hand tool. A frictional element may include rubber, texture, a rough surface, a rubber portion of a plate, a textured surface or the like and may even be placed on or even in part of a plate, such as in a center area. A frictional element may provide better gripping of a user to a hand tool which may assist with ease use of a hand tool during removal of matter from a container and the like.

In embodiments, the present invention may provide a kit. A kit may include a set or collection of tools, supplies, instructional matter and the like. A kit may be packaged or even made available to consumers. For example, a kit may include any item that may be necessary for a specific purpose, such as but not limited to drywalling, grouting, painting and the like. In an embodiment, a kit may include a curved plate, a bucket, a bucket lid and the like. Another kit may include a curved plate, a bucket, a bucket lid, a cloth, and the like. Yet another kit may include a curved plate, a bucket, a bucket lid, a mixing substance, a cloth, and the like. Of course other items may be included in a kit, such as those items described herein and all are meant to be included in this disclosure.

As can be easily understood from the foregoing, the basic concepts of the present invention may be embodied in a variety of ways. It involves both techniques as well as devices to accomplish the appropriate hand tool. In this application, the hand tool techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Apparatus claims may not only be included for the device described, but also method or process claims may be included to address the functions the invention and each element performs. Neither the description nor the terminology is intended to limit the scope of the claims in this or in any subsequent patent application.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure and may be relied upon when drafting the claims for any subsequent patent application. It should be understood that such language changes and broader or more detailed claiming may be accomplished at a later date. With this understanding, the reader should be aware that this disclosure is to be understood to support any subsequently filed patent application that may seek examination of as broad a base of claims as deemed within the applicant's right and may be designed to yield a patent covering numerous aspects of the invention both independently and as an overall system.

Further, each of the various elements of the invention and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "scoop" should be understood to encompass disclosure of the act of "scooping"—whether explicitly discussed or not—and, conversely, were there effectively disclosure of the act of "scooping", such a disclosure should be understood to encompass disclosure of a "scoop" and even a "means for scooping." Such changes and alternative terms are to be understood to be explicitly included in the description.

Any patents, publications, or other references mentioned in this application for patent as well as any priority case are hereby incorporated by reference. In addition, as to each term used it should be understood that unless its utilization in this application is inconsistent with a broadly supporting interpretation, common dictionary definitions should be understood as incorporated for each term and all definitions, alternative terms, and synonyms such as contained in the Random House Webster's Unabridged Dictionary, second edition are hereby incorporated by reference. Finally, all references listed in the list of References or other information statement filed with the application are hereby appended and hereby incorporated by reference, however, as to each of the above, to the extent that such information or statements incorporated by reference might be considered inconsistent with the patenting of this/ these invention(s) such statements are expressly not to be considered as made by the applicant(s).

Thus, the applicant(s) should be understood to have support to claim and make a statement of invention to at least: i) each of the hand tool devices as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) the various combinations and permutations of each of the elements disclosed, and xii) each potentially dependent claim or concept as a dependency on each and every one of the independent claims or concepts presented.

With regard to claims whether now or later presented for examination, it should be understood that for practical reasons and so as to avoid great expansion of the examination burden, the applicant may at any time present only initial claims or perhaps only initial claims with only initial dependencies. Support should be understood to exist to the degree required under new matter laws—including but not limited to European Patent Convention Article 123(2) and United States Patent Law 35 U.S.C. §132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible.

Finally, any claims set forth at any time are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

I claim:

1. A hand-held matter removal apparatus comprising:

a rectangular curved plate of a hand-held tool with an inner surface and an outer surface;

wherein said curved plate comprises a shape substantially similar to an arc of an inner side surface of a stackable circular bucket;

two straight side edges of said curved plate;

a flat bottom edge of said curved plate;

a curved handle-hanger element of said hand-held tool longitudinally located along a top of said curved plate; wherein said curved handle-hanger element is shaped to substantially fit over a rim of said stackable circular bucket allowing said curved plate and said curved handle-hanger element to hang from said rim; and wherein said curved handle-hanger element and said curved plate are shaped to hang in-between two stacked buckets; and two taper elements, each one located on a corner of said curved plate, said taper elements comprising an inward taper starting from each of said straight side edges and tapering toward said handle-hanger element, said taper element capable of prevention of matter build-up in said handle-hanger element.

2. A hand-held matter removal apparatus according to claim 1 wherein said shape substantially similar to an arc of an inner side surface of a stackable circular bucket comprises a shape substantially similar to an arc of an inner side surface of a five gallon stackable circular bucket.

3. A hand-held matter removal apparatus according to claim 1 wherein said flat bottom edge comprises a tapered edge.

4. A hand-held matter removal apparatus according to claim 1 and further comprising a hanger hole within said curved plate.

5. A hand-held matter removal apparatus according to claim 4 wherein said hanger hole is located in a upper corner of said curved plate.

6. A hand-held matter removal apparatus according to claim 4 wherein said hanger hole is capable of attachment with an attachment element selected from a group consisting of a nail, peg, string and loop.

7. A hand-held matter removal apparatus according to claim 1 wherein said hand-held tool comprises an easy bucket unstacker.

8. A hand-held matter removal apparatus according to claim 1 wherein said curved plate removes matter from an inner side surface of said bucket.

9. A hand-held matter removal apparatus according to claim 8 wherein said matter is selected from a group consisting of adhesives, ceramics, floor mastics, sheet rock components, grout, mortars, drywall, paint, dirt, thin-set, thin-set with grout, mud, earth, drywall compound, wet matter, and dry matter.

10. A hand-held matter removal apparatus according to claim 1 and further comprising at least one end point of said curved plate.

11. A hand-held matter removal apparatus according to claim 10 wherein said at least one end point comprises a 90 degree angle end point.

12. A hand-held matter removal apparatus according to claim 1 wherein said taper elements have an angle selected from a group consisting of:

about 10 degrees;
about 15 degrees;
between about 5 degrees and about 15 degrees;
between about 5 degrees and about 20 degrees; and
at least 5 degrees.

13. A hand-held matter removal apparatus according to claim 1 and further comprising at least one dynamic contact point between said curved plate and a surface during use of said hand-held tool.

14. A hand-held matter removal apparatus according to claim 13 and further comprising an angled position with respect to an inner side surface said bucket.

15. A hand-held matter removal apparatus according to claim 14 wherein said angled position comprises two dynamic contact points near each end of a bottom edge of said curved plate and said inner side surface of said bucket.

16. A hand-held matter removal apparatus according to claim 15 wherein said angled position comprises a curved plated at an angle selected from a group consisting of:

greater than about 20 degrees;
greater than about 45 degrees; and
greater than about 60 degrees.

17. A hand-held matter removal apparatus according to claim 1 and further comprising a steep angled position with respect to an inner side surface of said bucket.

18. A hand-held matter removal apparatus according to claim 17 wherein said steep angled position comprises an angle of said curved plate from said inner side surface of said bucket, said angle selected from a group consisting of:

less than about 20 degrees;
less than about 15 degrees;
less than about 10 degrees; and
less than about 5 degrees.

19. A hand-held matter removal apparatus according to claim 17 wherein said steep angled position comprises a dynamic contact point at a middle of a bottom edge of said curved plate and said inner side surface of said bucket.

20. A hand-held matter removal apparatus according to claim 1 wherein said curved plate comprises a material selected from a group consisting of rigid material, plastic, high density polyethylene, polypropylene, galvanized metal, stainless steel, 1/16 inch plastic, 1/32 inch plastic, 3/32 inch plastic, 22 gauge galvanized metal, 24 gauge galvanized metal, 22 gauge stainless steel and 24 gauge stainless steel.

21. A hand-held matter removal apparatus according to claim 1 wherein said shape substantially similar to an arc of an inner side surface of a stackable circular bucket comprises a shape substantially similar to an arc of an inner side surface of a three gallon stackable circular bucket.

22. A hand-held matter removal apparatus according to claim 1 wherein said straight side edge comprises a substantially sharp side edge.

23. A hand-held matter removal apparatus according to claim 1 wherein said straight side edge comprises a dull side edge.

24. A hand-held matter removal apparatus according to claim 1 wherein said flat bottom edge comprises a sharp edge.

25. A hand-held matter removal apparatus according to claim 1 wherein said curved handle-hanger element comprises an inverted u-shaped surface.

26. A hand-held matter removal apparatus according to claim 1 wherein said curved handle-hanger element comprises a gap selected from a group consisting of about 3/8 inch and about 1/2 inch.

27. A hand-held matter removal apparatus according to claim 1 wherein said handle-hanger element comprises a reinforced top surface.

28. A hand-held matter removal apparatus according to claim 1 wherein said inner surface of said curved plate comprises an inner concave surface of said curved plate and wherein said outer surface of said curved plate comprises an outer convex surface of said curved plate.

29. A hand-held matter removal apparatus according to claim 1 and further comprising a kit with said curved plate, a bucket, and a bucket lid.

30. A hand-held matter removal apparatus according to claim 1 and further comprising a kit with said curved plate, a bucket, a bucket lid, and a cloth.

31. A hand-held matter removal apparatus according to claim 1 and further comprising a kit with said curved plate, a bucket, a bucket lid, a mixing substance, and a cloth.

32. A hand-held matter removal apparatus according to claim 31 wherein said mixing substance is selected from a group consisting of adhesives, ceramics, floor mastics, sheet rock components, grout, mortars, drywall, paint, dirt, thin-set, thin-set with grout, mud, earth, drywall compound, wet matter and dry matter.

33. A hand-held matter removal apparatus according to claim 1 wherein said curved plate comprises a flexible curved plate.

34. A hand-held matter removal apparatus according to claim 1 wherein said curved plate comprises a one-piece construction.

35. A hand-held matter removal apparatus according to claim 1 wherein said curved plate comprises a two-piece construction.

36. A hand-held matter removal apparatus according to claim 1 wherein said curved plate comprises a fast bucket cleaner tool.

37. A hand-held matter removal apparatus according to claim 36 wherein said fast bucket cleaner tool can clean a dirty bucket in a time selected from a group consisting of:

less than about 2 minutes;
less than about 1 minute 30 seconds;
less than about 1 minute 20 seconds; and
less than about 1 minute 15 seconds.

38. A hand-held matter removal apparatus according to claim 1 wherein said rim of said stackable circular bucket comprises a rim of a five gallon stackable circular bucket.

* * * * *